United States Patent [19]

Brandt et al.

[11] Patent Number: 4,915,734

[45] Date of Patent: Apr. 10, 1990

[54] CEMENTED CARBONITRIDE ALLOY WITH IMPROVED TOUGHNESS BEHAVIOUR

[75] Inventors: Nils G. L. Brandt, Solna; Zeljka D. Senesan, Stockholm, both of Sweden

[73] Assignee: Sandvik AB, Sandviken, Sweden

[21] Appl. No.: 186,310

[22] Filed: Apr. 26, 1988

[30] Foreign Application Priority Data

Apr. 29, 1987 [SE] Sweden ..... 8701791

[51] Int. Cl.[4] ..... B22F 1/00

[52] U.S. Cl. ..... 75/229; 75/236; 75/238; 75/239; 75/240; 75/242; 419/23

[58] Field of Search ..... 75/236, 238, 242, 239, 75/240, 229; 419/23

[56] References Cited

U.S. PATENT DOCUMENTS

| | | | |
|---|---|---|---|
| 3,507,632 | 4/1970 | Swoboda | 75/229 |
| 3,728,108 | 4/1973 | Sifterlen et al. | 75/229 |
| 4,543,345 | 9/1985 | Wei | 501/95 |
| 4,557,893 | 12/1985 | Jatkar et al. | 419/12 |
| 4,623,388 | 11/1986 | Jatkar et al. | 75/232 |
| 4,852,999 | 8/1989 | Mehrotra et al. | 51/309 |
| 4,867,761 | 9/1989 | Brandt et al. | 51/309 |

*Primary Examiner*—Stephen J. Lechert, Jr.
*Assistant Examiner*—Nina Bhat
*Attorney, Agent, or Firm*—Burns, Doane, Swecker & Mathis

[57] ABSTRACT

The present invention relates to a cemented carbonitride alloy in which the toughness has been improved by the incorporation in the structure of whiskers of nitrides, carbides and/or carbonitrides of titanium, zirconium and/or hafnium.

5 Claims, 1 Drawing Sheet

CEMENTED CARBONITRIDE ALLOY WITH IMPROVED TOUGHNESS BEHAVIOUR

Figure 1:
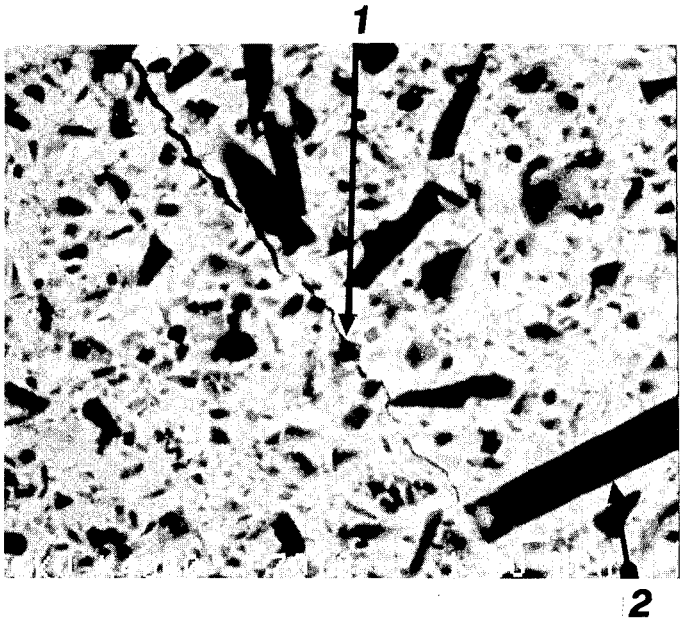

The present invention relates to a cemented carbonitride alloy with improved toughness.

Alloys based on titanium carbide have been used for finishing of steels but have only found limited applicability because of limitations in several important properties. The strength and toughness of TiC-based cutting tools are generally much lower than for WC-based tools, thus limiting the use of TiC-based tools in applications with higher feed rates and/or interrupted cutting. The resistance to plastic deformations is also generally very poor which seriously limits the use at higher cutting speeds and feeds. TiC-based tools also have a very low thermal conductivity, much lower than WC-based tools, and, consequently, thermal cracking is a serious problem.

To some extent these problems have been overcome with TiN as an alloying additive. TiN reduces grain size which improves strength and toughness. TiN also increases the thermal conductivity of the tool and, consequently, resistance against thermal cracking is improved. The resistance against plastic deformation is also improved for several reasons of which on is increased alloying (solid solution hardening) of the binder phase.

However, the lack of adequate toughness is still a major problem for many applications why cemented carbonitrides must be used at lower feed rates than conventional cemented carbides.

An object of the present innovation is to provide a cemented carbonitride with improved properties especially related to the above mentioned disadvantages and especially with respect to toughness behaviour.

The cemented carbonitride of this invention comprises 5–50%, preferably 15–35%, by volume of whiskers of at least one hard compound selected from the nitrides, carbides and carbonitrides of titanium, zirconium and hafnium and mutual solid solutions thereof, further 25–82% by volume of hard phases comprising carbides and/or nitrides of metals and solid solutions thereof from groups IVb (Ti, Zr, Hf), Vb (V, Nb, Ta) and/or VIb (Cr, Mo, W) in the periodic table of the elements and 3–25% by volume of a binder metal being at least one element selected from the group consisting of iron, cobalt and nickel.

The cemented carbonitride with the characteristics of the above description has a much improved toughness behaviour than conventional cemented carbonitrides.

DE No. 21 01 891 discloses a method of producing carbide whiskers. It is suggested that whiskers may be used as reinforcing elements for conventional materials such as metals, ceramics or plastics. DE No. 22 14 824 discloses the reinforcement of cemented carbide with fibres or whiskers of the metals W, Mo, Ti, Ta, Cr, Zr and Hf coated with a thin layer of Fe, Co or Ni. From Example 4 of U.S. Pat. No. 3,507,632 is known a conventional cemented carbide material reinforced with whiskers such as 0.2% TiC-whiskers. Example 6 of the same patent discloses a hard material composition based on nitrides of W, Ta, Ti and Nb and with an iron binder which composition comprises 0.3% TiN-whiskers. JP No. 59-54675, JP No. 59-54676 and JP No. 59-54680 disclose SiC whisker reinforced $Si_3N_4$ or SiC materials.

TiC-based cemented carbides with additions of other carbides like WC and $Mo_2C$ to improve wetting properties generally form a two phase structure consisting of nearly unchanged TiC-cores and a rim rich in WC and $Mo_2C$ forming the main interface with the binder alloy.

However, the latter phase, being a solid solution, is prone to grain growth during sintering and consequently a rather large grain size obtained. This is detrimental to both strength and wear characteristics.

Additions of TiN drastically reduces the grain growth of TiC-based carbides mainly because the second phase, in contact with the binder, now consists of a carbonitride which is less prone to dissolution in the binder phase. TiN therefore has a favourable influence on strength and fracture toughness of the alloy. TiN also has a higher thermal conductivity than TiC and, consequently, the thermal conductivity of the alloy is increased leading to lower cutting edge temperatures and a more even temperature distribution for a given set of cutting data.

TiN therefore has a favourable influence on resistance to thermal cracking, temperature controlled wear mechanisms like solution/diffusion wear and resistance against plastic deformation.

$Mo_2C$ and WC improve the wetting properties of the hard phase and have further a grain refining influence which improves the strength of the alloy. Mo and W also reduce the tendency for plastic deformation due to solid solution strengthening of the binder alloy.

VC increases the hardness of the carbonitride and therefore increases the flank wear resistance of the alloy.

Despite the improvements of TiC-based cemented carbides that have been achieved due to addition of TiN the mechanical properties are still inferior to those of conventional cemented carbides with respect to strength and fracture toughness and, thus, cemented carbonitrides based on TiC or TiN are mainly used in finishing or semi finishing operations.

It has now surprisingly been shown that especially the toughness behaviour can be significantly improved with the addition of whiskers of at least one hard compound selected from the nitrides, carbides and carbonitrides of titanium, zirconium and hafnium and mutual solid solutions thereof. These whiskers are single crystals with a diameter of 0.5–10 μm and a length of 2.5–100 μm characterised in that the length/diameter ratio (aspect ratio) is preferably 5–20.

These whiskers have a high chemical stability and do not deteriorate the good wear resistance of the cemented carbonitride.

The invention is illustrated in FIG. 1 which is a SEM-micrograph of a material according to the invention in which 1* - illustrates crack deflection in the structure and 2* - shows a TiN-whisker.

The actual tool material is processed with wet milling and mixing of suitable amounts of carbides and/or nitrides and/or carbonitrides of metals from group IVb, Vb and VIb and at least one metal from the iron group (iron, cobalt and nickel) together with single-crystal whisker crystals. After drying the mixed powder is pressed to a suitable geometrical shape and sintered with or without an applied pressure to theoretical or near theoretical density. The sintering can be performed in vacuum but nitrogen atmosphere is needed at high amounts of nitrides in the alloy. After the sintering any residual closed porosity can be removed by hot isostatic pressing.

The use of whisker reinforcement leads to a significant increase of the fracture toughness. The mechanisms leading to this improvement can be load transfer between whisker and matrix, crack deflection and whisker pullout. These mechanisms are dependent on that the crack growth takes place along a sufficiently weak interface between whisker and matrix. The bonding strength between whisker and matrix is therefore an important parameter. To gain an optimum influence of the whisker reinforcement it is therefore essential that chemical reactions between matrix and whisker is kept to a minimum to ensure that the bonding strength is sufficiently weak to permit the interface to become a preferable fracture path. Chemical reactions can be influenced by suitable thin coatings of the whisker material which will prevent diffusion of elements between whisker and matrix. Carbide- and to some extent also carbonitride whiskers will generally react with the carbonitride matrix to form an intermediate phase with strong bonding to both whisker and matrix. The increase in toughness in this case is only moderate. These whiskers should therefore preferably be treated (e.g. coated) to form a less reactive surface layer. On the other hand nitride whiskers are less prone to react with the matrix and interphases are not formed. This type of whisker can therefore be used without any surface treatment and is, thus, to be preferred. It is, however, essential that sintering times and temperatures should be kept as short and low as possible to avoid deterioration of the whisker material. Sintering temperatures must therefore be kept below 1600° C.

X-ray diffraction analysis (XRD) is a useful method of checking that the above prerequisites are fulfilled. Besides the peaks from binder and carbonitride solid solution matrix peaks from unreacted (unchanged lattice parameter) whisker single crystal material must be present.

To facilitate the understanding of the invention examples are given below regarding fabrication and properties of tool material according to the invention. The whisker material has been produced with CVD-technique but is obvious for a skilled person that similar results can be obtained with alternative methods for production of whiskers.

EXAMPLE 1

Titanium nitride whiskers were produced in a CVD-reactor through coating of nickel sponge from a gas mixture of $TiCl_4$, $N_2$ and $H_2$ at a temperature of about 1200° C. The whisker crystals were removed from the nickel sponge with ultrasonic treatment and mechanical brushing in an acetone bath. The majority of the whiskers had a diameter of 0.5–2 μm and a length of 20–100 μm.

30% by volume of titanium nitride whiskers were wet blended and milled with a powder mixture of 35% by volume TiC, 10% by volume TiN, 2% by volume TaC, 4% by volume VC, 5% by volume $Mo_2C$, 6% by volume Co and 3% by volume Ni. After drying in vacuum the mixture was dry blended and pressed to blanks SNGN 120412. The blanks were sintered in nitrogen at 10 torr at 1550° C. for 1 hour to 99.6% of theoretical density. XRD of the sintered material showed peaks from three different phases: TiC solid solution, Ni-Co-binder and TiN. The lattice parameter for TiN was 4.24 Å which is the same as for the whisker raw material.

The fracture toughness ($K_{IC}$) was measured using the indentation method. An impression is made with the aid of a pyramid shaped diamond indenter and $K_{IC}$ is calculated from the length of the cracks which are induced from the corners of the indenter.

A reference sample was used at the measurement with a composition almost identical to that of the whisker containing material but where all TiN was present as equiaxed grains. However, the content of W and Mo had to be reduced in the reference material as in this case TiN will form a solid solution with the other added carbide material and without lowering Mo and W etaphase will appear. XRD of the reference material showed only two phases, Ti(C,N) solid solution and Ni-Co-binder.

The result from the $K_{IC}$-measurements is given in table 1.

TABLE 1

| | Composition % by volume | | | | | | | | | | |
|---|---|---|---|---|---|---|---|---|---|---|---|
| | TiC | TaC | VC | $Mo_2C$ | WC | TiN | TiNw | Co | Ni | $K_{IC}$ | |
| 1 | 39 | 2 | 4 | 3 | 3 | 40 | — | 6 | 3 | 7.4 | (prior art) |
| 2 | 35 | 2 | 4 | 5 | 5 | 10 | 30 | 6 | 3 | 10.2 | (according to the invention) |

It is obvious from the table that incorporation of TiN-whiskers has given a significant increase of the fracture toughness. The fracture toughness is a parameter which shows the ability of the material to resist mechanical stresses without catastrophic failure.

EXAMPLE 2

Inserts SNGN 120412 were manufactured from the two powder blends according to table 1 and were tested in both continuous and discontinuous turning operations of steel.

(a) Basic toughness

The toughness behaviour was tested in an intermittent operation of steel SS 2244. The workpiece consists of two plates fixed together with a bolt and a spacer to maintain a small distance between the plates. The maximum feed capability was determined in a test where the feed rate was increased in steps of 0.05 mm $rev^{-1}$ every 30 s. A total number of 30 edges per variant were tested and maximum feed rate was determined as the feed rate where 50% of the edges survived. The result is given in table 2.

TABLE 2

| | Maximum feed rate mm $rev^{-1}$ |
|---|---|
| 1 | 0.25 |
| 2 | 0.40 |

As shown from table 2 whisker reinforcement significantly improves the ability to resist high mechanical loads.

(b) Wear resistance

Wear resistance was tested in a continuous turning operation of steel SKF25 at 230 m $min^{-1}$ at a feed rate of 0.20 mm $rev^{-1}$ and depth of cut 1.0 mm. The dominating wear in this operation is crater wear but flank wear also takes place.

TABLE 3

| | Relative wear resistance | |
|---|---|---|
| | Flank wear | Crater wear |
| 1 | 1.1 | 0.95 |
| 2 | 0.9 | 1.05 |

As shown from table 3 there is no significant difference between the two variants in wear resistance.

We claim:

1. Sintered carbonitride-based cutting tool comprising 5–50% by volume of whiskers of at least one hard compound selected from the nitrides, carbides and carbonitrides of titanium, zirconium and hafnium and mutual solid solutions thereof, said whiskers having a surface which minimizes reactions between the whiskers and the carbonitride matrix of said cutting tool, 25–82% by volume of hard phases comprising carbides and/or nitrides of metals an solid solutions thereof from groups IVb, Vb and/or VIb in the periodic table of the elements and 3–25% by volume of a binder metal being at least one element selected from the group consisting of iron, cobalt and nickel, forming a structure comprising essentially a three phase mixture as identified by X-ray diffraction analysis of: a hard phase comprising carbides and/or nitrides and solid solutions thereof, binder metal and whisker single crystal phase.

2. The sintered carbonitride-based cutting tool of claim 1, wherein said whiskers are present in an amount of from 15–35% by volume.

3. The sintered carbonitride-based cutting tool of claim 1, wherein said whiskers are single crystal whiskers with a diameter of 0.5–10 μm and a length of 2.5–100 μm.

4. The sintered carbonitride-based cutting tool of claim 1, wherein said whiskers are of Titanium Nitride.

5. The sintered carbonitride-based cutting tool of claim 1, wherein said whiskers are carbides and carbonitrides coated to form said surface.

* * * * *